US007389070B2

(12) United States Patent
Onishi

(10) Patent No.: US 7,389,070 B2
(45) Date of Patent: Jun. 17, 2008

(54) IMAGE FORMING APPARATUS HAVING CHARGE MEMBER AND PRESSING MEMBER

(75) Inventor: Akihito Onishi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 4 days.

(21) Appl. No.: 11/345,378

(22) Filed: Feb. 2, 2006

(65) Prior Publication Data

US 2006/0188294 A1 Aug. 24, 2006

(30) Foreign Application Priority Data

Feb. 21, 2005 (JP) ..... 2005-044330

(51) Int. Cl.
*G03G 15/02* (2006.01)

(52) U.S. Cl. ..... 399/168; 399/176

(58) Field of Classification Search ..... 399/168, 399/176

See application file for complete search history.

(56) References Cited

U.S. PATENT DOCUMENTS 5,146,280 A * 9/1992 Kisu ..... 399/176
2006/0099005 A1* 5/2006 Kitazawa et al. ..... 399/100

FOREIGN PATENT DOCUMENTS

JP 2001-350321 12/2001

* cited by examiner

*Primary Examiner*—David M. Gray
*Assistant Examiner*—Bryan Ready
(74) *Attorney, Agent, or Firm*—Kubotera & Associates, LLC

(57) ABSTRACT

An image forming apparatus includes: an image supporting member; a charge roller for charging the image supporting member; a gap setting member disposed on the charge roller for setting a gap between the image supporting member and the charge roller; and a pressing member disposed at a position corresponding to the gap setting member for pressing the charge roller against the image supporting member. Accordingly, it is possible to form a constant gap between the charge roller and the image supporting member, thereby consistently charging the image supporting member.

27 Claims, 6 Drawing Sheets

IMAGE FORMING APPARATUS HAVING CHARGE MEMBER AND PRESSING MEMBER

BACKGROUND OF THE INVENTION AND RELATED ART STATEMENT

The present invention relates to an image forming apparatus.

In a conventional image forming device of an electric photography type such as a printer, a copier, and a facsimile, a charge roller charges a surface of a photosensitive drum. An exposure device exposes the photosensitive drum to form a static latent image thereon. A developing device develops the static latent image to form a toner image. A transfer roller transfers the toner image to a sheet. A cleaning device removes toner remaining on the photosensitive drum after the transfer roller transfers the toner image.

In a non-contact type charge device disclosed in Patent Reference 1, a charge roller includes a metal shaft and an elastic layer formed of a conductive rubber and disposed on the metal shaft. A resin coating layer and a surface modified layer are disposed on the elastic layer. The charge roller is arranged close to a photosensitive drum. A voltage is applied to the charge roller, so that the charge roller charges a surface of the photosensitive drum.

In the conventional non-contact type charge device, pressing members are disposed at both ends of a shaft of the charge roller, so that the charge roller is pressed against the photosensitive drum. Further, gap setting members are disposed on an elastic layer of the charge roller at both ends thereof for forming a gap between the charge roller and the photosensitive drum.

Patent Reference 1: Japanese Patent Publication No. 2001-350321

In the conventional non-contact type charge device, the pressing members are disposed at both ends of the shaft of the charge roller, so that the charge roller is pressed against the photosensitive drum. Accordingly, the charge roller may be deformed due to the pressing force. In this case, the gap becomes large at a center portion of the charge roller, and decreases toward the both ends thereof. Further, when the shaft has a smaller diameter, an extent of the deformation increases. As a result, it is difficult to form a constant gap between the charge roller and the photosensitive drum, thereby making it difficult to consistently charge the photosensitive drum.

In order to form a constant gap, the charge roller may be formed in a crown shape with high precision. In this case, it takes long time to machine the charge roller, thereby increasing cost of an image forming apparatus. Alternatively, the shaft may have a large diameter. In this case, the charge roller has a large outer diameter, thereby increasing a size of an image forming apparatus.

In view of the problems described above, an object of the present invention is to provide an image forming apparatus, in which it is possible to form a constant gap between a charge roller and a photosensitive drum with low cost configuration, thereby making it possible to consistently charge the photosensitive drum.

Further objects and advantages of the invention will be apparent from the following description of the invention.

SUMMARY OF THE INVENTION

In order to attain the objects described above, according to the present invention, an image forming apparatus comprises: an image supporting member; a charge roller for charging the image supporting member; a gap setting member disposed on the charge roller for setting a gap between the image supporting member and the charge roller; and a pressing member disposed at a position corresponding to the gap setting member for pressing the charge roller against the image supporting member.

In the invention, the image forming apparatus comprises: the image supporting member; the charge roller for charging the image supporting member; the gap setting member disposed on the charge roller for setting a gap between the image supporting member and the charge roller; and the pressing member disposed at the position corresponding to the gap setting member for pressing the charge roller against the image supporting member.

In particular, the pressing member is disposed at the position corresponding to the gap setting member for pressing the charge roller against the image supporting member. Accordingly, it is possible to form a constant gap between the charge roller and the image supporting member, thereby consistently charging the image supporting member. Further, it is not necessary to machine the charge roller in a crown shape, thereby simplifying a manufacturing process and decreasing cost of the image forming apparatus. Also, it is possible to reduce an outer diameter of the charge roller, thereby decreasing a size of the image forming apparatus.

DETAILED DESCRIPTION OF PREFERRED EMBODIMENTS

Figure 1:
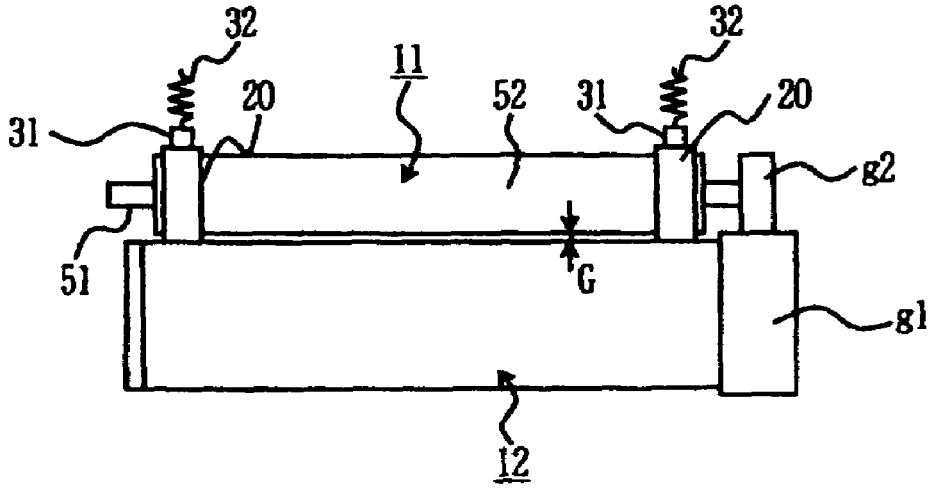
FIG. 1 is a schematic view showing a charge device according to a first embodiment of the present invention.

Hereunder, embodiments of the present invention will be explained with reference to the accompanying drawings. Components common in the drawings are designated by common reference numerals.

Figure 2:
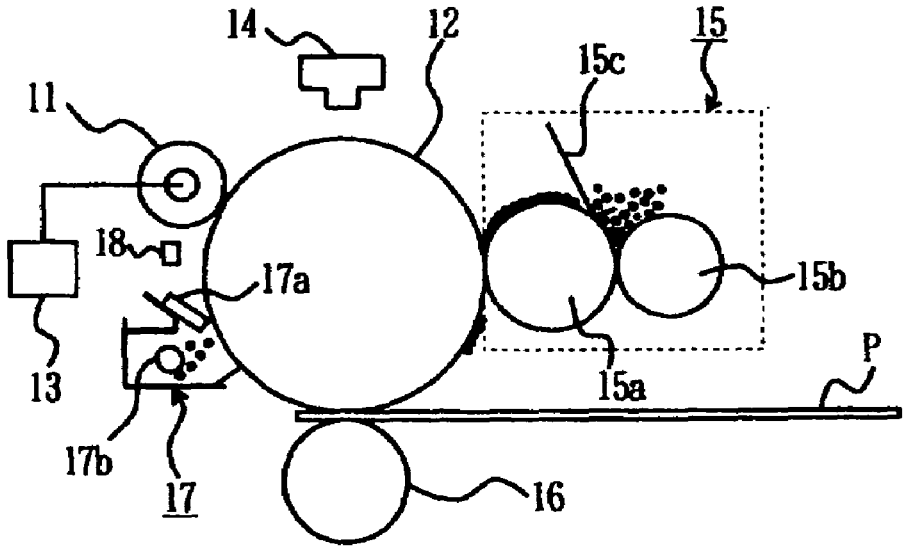
FIG. 2 is a schematic view showing an image forming apparatus according to the first embodiment of the present invention.

FIG. 2 is a schematic view showing an image forming apparatus according to a first embodiment of the present invention. As shown in FIG. 2, the image forming apparatus includes a charge roller 11 adapted to rotate freely; a photosensitive drum 12 as an image supporting member adapted to rotate freely; and a power source 13 connected to the charge roller 11. The power source 13 applies a specific voltage to the charge roller 11, so that a surface of the photosensitive drum 12 is charged uniformly. The charge roller 11 and the power source 13 constitute a non-contact type charge device.

An exposure device 14 formed of LED exposes the surface of the photosensitive drum 12 charged with the charge roller 11, so that a static latent image is formed on the surface of the photosensitive drum 12. A developing device 15 attaches toner as developer to the static latent image for developing, so that a toner image is formed as a developer image. The developing device 15 includes a developing roller 15*a* adapted to contact with the photosensitive drum 12 and rotate freely; a toner supply roller 15*b* as a developer supply roller adapted to contact with the developing roller 15*a* and rotate freely; and a developing blade 15*c* adapted to contact with the developing roller 15*a*.

A transfer roller 16 is provided as a transfer device for transferring the toner image to a sheet P as a medium. A cleaning device 17 removes toner remaining on the photosensitive drum 12 to be collected after the transfer roller 16 transfers the toner image. The cleaning device 17 includes a cleaning blade 17*a* formed of a urethane rubber; and a spiral member 17*b* for collecting and transporting toner. A neutralization device 18 formed of an LED lamp is provided for removing electricity on the surface of the photosensitive drum 12.

The charge device will be explained next. FIG. 1 is a schematic view showing the charge device according to the first embodiment of the present invention. As shown in FIG. 1, the charge roller 11 includes a shaft 51 with conductivity and an elastic layer 52 formed of a rubber and coated on the shaft 51. Gap setting members 20 are disposed at both end portions of the charge roller 11 for covering the elastic layer 52 in a cyclic shape or an annular shape. The gap setting members 20 are provided for forming a specific gap G between the charge roller 11 and the photosensitive drum 12 over a charge area on the photosensitive drum 12.

Pressing members 31 and springs 32 as urging members are disposed above the gap setting members 20. The springs 32 apply a specific pressing force to the pressing members 31 within a range of 150 to 500 gf, so that the pressing members 31 press the charge roller 11 against the photosensitive drum 12. The pressing members 31 are molded components formed of a material with a low coefficient of friction such as polyacetal (POM), so that the gap setting members 20 are not worn or deteriorated. A metal such as stainless and aluminum may be used in place of polyacetal.

A gear g1 is disposed at one end portion of the photosensitive drum 12, and a gear g2 is disposed at one end portion of the charge roller 11 for engaging the gear g1. The charge roller 11 receives a rotation of the photosensitive drum 12 through the gears g1 and g2 for charging the surface of the photosensitive drum 12 while rotating.

In the charge roller 11, the elastic layer 52 is formed of a rubber material having a rubber hardness in a high hardness range at least JISA 50°, preferably JISA 80°, so that the charge roller 11 does not contact with the photosensitive drum 12 when the charge roller 11 is pressed and deformed. In the embodiment, the elastic layer 52 is formed of an epichlorohydrin rubber, and may be formed of a conductive rubber such as a chloroprene rubber, a urethane rubber, an NBR rubber, a SBR rubber, and an EPDM rubber; a blend rubber thereof; and a modified rubber.

In the embodiment, the elastic layer 52 needs to have conductivity for charging the photosensitive drum 12, and has a resistance of $10^3$ to $10^9$ (Ω·cm), preferably $10^6$ to $10^8$ (Ω·cm). When the pressing members 31 press the gap setting members 20 against the photosensitive drum 12, the charge roller 11 receives pressure. In order to minimize deformation of the charge roller 11 upon receiving the pressure, the charge roller 11 has a permanent strain of less than 25%, preferably less than 5%, according to the wear test (JISK 6205). When the charge roller 11 has a large permanent strain, the charge roller 11 may be deformed after the charge roller 11 is pressed against the photosensitive drum 12 for a long time. In this case, it is necessary to provide a specific mechanism and control for separating the charge roller 11 from the photosensitive drum 12 by a specific gap. When the charge roller 11 has a permanent strain of less than 5%, it is not necessary to provide such a specific mechanism and control for separating the charge roller 11 from the photosensitive drum 12. Accordingly, it is possible to provide the image forming apparatus with a simple structure and low cost.

In the embodiment, the gap setting members 20 are formed of an insulating material such as a polyethylene terephthalate (PET) film having a thickness of 100 μm. An adhesive is applied to one side of the gap setting members 20, so that the gap setting members 20 are attached to a surface of the elastic layer 52. In the embodiment, the gap setting members 20 may be formed of polyethylene (PE), polypropylene (PP), polyester (PES), polystyrene (PS), polyacetal, an ABS resin, an amino resin, a urethane resin, an acryl resin, a fluoride resin, and a silicon resin. Further, the gap setting members 20 are disposed on a photosensitive layer of the photosensitive drum 12. Accordingly, the gap setting members 20 are preferably formed of a material not damaging and wearing the photosensitive layer.

In the embodiment, the charge roller 11 does not directly contact with the photosensitive drum 12 over the charge area, and the gap G in a range of 20 to 100 μm is formed therebetween. When a printing operation is repeated, toner or foreign matter on the photosensitive drum 12 may stick to the surface of the charge roller 11 due to the small gap. Further, when the charge roller 11 inadvertently contacts with the photosensitive drum 12, the photosensitive drum 12 may be stained. To prevent these situations, it is preferred to coat the surface of the elastic layer 52 with a conductive coating resin layer, a processed surface layer, or a modified surface layer. In the embodiment, a dilute solution of isocyanate such as MDI is applied to the surface of the elastic layer 52, so that a process surface layer is formed after the solution is heated and set. As the modified surface layer, the surface of the elastic layer 52 may be coated with a conductive resin layer formed of a material such as a urethane resin, a fluoride resin, an epoxy resin, an acryl resin, a melamine resin, a phenol resin, and a silicon resin. Such a resin layer may be irradiated with ultraviolet light or electron beams to form the processed surface layer.

Figure 3:
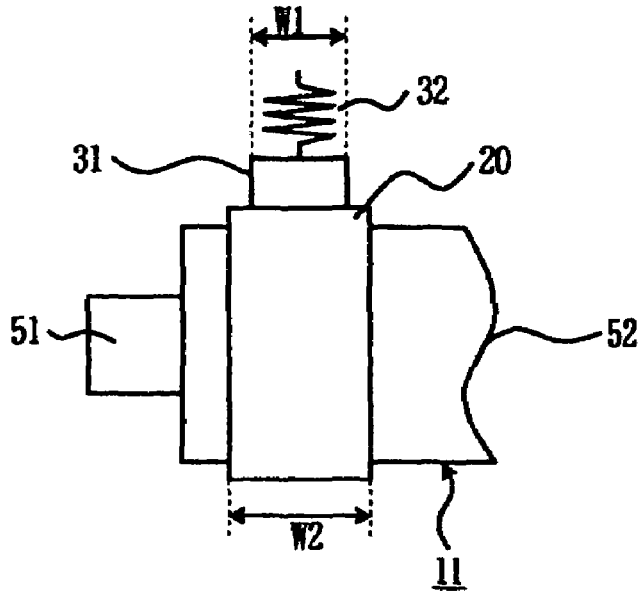
FIG. 3 is a detailed view of the charge device according to the first embodiment of the present invention.
Figure 4:
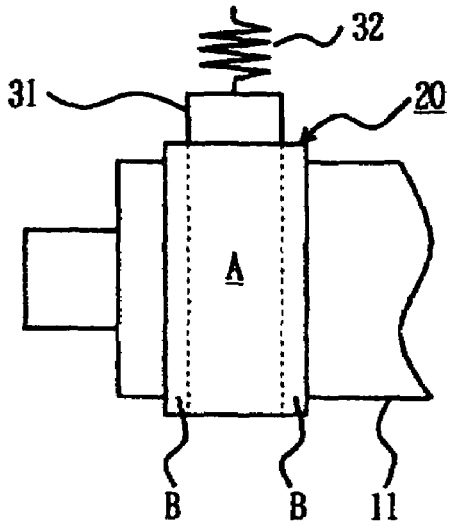
FIG. 4 is a detailed view of the charge device according to the first embodiment of the present invention.

An operation of the charge device will be explained next. FIG. 3 is a detailed view of the charge device according to the first embodiment of the present invention. FIG. 4 is another detailed view of the charge device according to the first embodiment of the present invention.

The charge roller 11 receives rotation of the photosensitive drum 12 (FIG. 1) to rotate at a circumferential speed same as that of the photosensitive drum 12. The power source 13 applies a DC voltage and an AC voltage to the charge roller 11 simultaneously, so that the photosensitive drum 12 is charged at a constant potential. At this time, the pressing members 31 slide against the gap setting members 20. Accordingly, it is necessary to prevent the gap setting members 20 from wearing, thereby maintaining the gap G constant. To this end, the gap setting members 20 and the pressing members 31 are formed of a material with a low coefficient of friction. Further, the springs 32 apply a minimum pressure just enough for stably positioning the charge roller 11 on the photosensitive drum 12.

In the embodiment, the pressing members 31 have a width W1 smaller than a width W2 of the gap setting members 20. In an axial direction of the charge roller 11, the pressing members 31 are positioned at the center of the gap setting members 20. It is preferred that each of the gap setting members 20 has both end portions not sliding against the pressing members 31 in a range of more than 1.0 mm. With the configuration, each of the gap setting members 20 has an area A sliding against the pressing members 31 at the center thereof, and areas B not sliding against one of the pressing members 31 at both sides of the area A.

In the area A, when the gap setting members 20 slide against the pressing members 31, the gap setting members 20 are worn gradually. In the areas B, since the gap setting members 20 do not slide against the pressing members 31, the gap setting members 20 are not worn, thereby maintaining a thickness of the gap setting members 20 constant. Accordingly, it is possible to maintain the gap G constant. When a difference between the width W2 of the gap setting members 20 and the width W1 of the pressing members 31 increases, it is possible to stably set the gap G.

In the embodiment, the elastic layer 52 has a length of about 340 mm in an axial direction thereof and an outer diameter of 10 mm, and the shaft 51 has a length (axial length) of about 412 mm in an axial direction thereof and an outer diameter of 6 mm, so that it is possible to print a sheet P having an A3 size. A pressure of about 250 fg is applied to the gap setting members 20 through the pressing members 31, so that the charge roller 11 is pressed against the photosensitive drum 12. Note that the photosensitive drum 12 has an outer diameter of 30 mm.

With the configuration described above, it is possible to form the gap G with a constant width over the charge area, confirmed through a leaking light test. In the leaking light test, light with 1000 lux is irradiated from behind the charge roller 11 and the photosensitive drum 12, so that light leaking through the gap G between the charge roller 11 and the photosensitive drum 12 is observed.

A continuous printing test will be explained next. In the continuous printing test, the charge roller 11 rotated at a circumferential speed of 180 mm/sec, and an A4 sheet P was printed at a printing density of 5% under a constant condition. In the continuous printing test, the charge roller 11 according to the first embodiment was compared with comparative examples No. 1 and No. 2 as well as a conventional roller. The result is shown in Table 1.

TABLE 1

| | First embodiment | Comparative example No. 1 | Comparative example No. 2 | Conventional roller |
|---|---|---|---|---|
| Pressing member | POM | POM | POM | POM |
| Pressing force (gf) | 250 | 250 | 150 | 250 |
| Gap setting member | PET | PET | PET | PET |
| Pressing location | Gap setting member | Gap setting member | Gap setting member | Shaft |
| W1 vs. W2 | W1 < W2 | W1 ≧ W2 | W1 ≧ W2 | NA |
| Initial Gap Uniformity | Good | Good | Fair | Poor (large at center) |
| Gap Stability (gap setting member durability) | Good | Fair | Fair | Fair |

The comparative example No. 1 had a configuration same as that in the first embodiment except that the width W1 of the pressing members 31 was larger than the width W2 of the gap setting members 20. The comparative example No. 2 had a configuration same as that in the first embodiment except that the width W1 of the pressing members 31 was larger than the width W2 of the gap setting members 20, and further the pressing force was smaller than that in the first embodiment and the comparative example No. 1.

In Table 1, the initial gap uniformity was evaluated through uniformity of light leaking through the gap G and print quality. The gap stability (gap setting member durability) was evaluated through print quality and the uniformity of light after the photosensitive drum 12 was rotated 30000 times, which is regarded as a life of an ID cartridge. In the initial gap uniformity and the gap stability, the image quality was evaluated. When the image quality had no defect, the result was designated as good. When an image in half tone slightly showed irregularity, the result was designated as fair. When the image showed clear irregularity associated with the cycle of the charge roller 11, the result is designated as poor.

As shown in Table 1, the conventional roller had a large gap at the center thereof, and it was difficult to obtain a constant gap over the charge area from an initial stage of the test. On the other hand, in the first embodiment and the comparative examples No. 1 and No. 2, in which the charge roller was pressed in a way different from that of the conventional roller, it was possible to stably form the gap G.

In the comparative example No. 1, as compared with the first embodiment, the width W1 of the pressing members 31 was larger than the width W2 of the gap setting members 20. Accordingly, after the continuous printing operation, the gap setting members 20 were damaged or worn, thereby making it difficult to stable form the gap G. In the comparative example No. 2, the pressing force was smaller than that in the first embodiment and the comparative example No. 1. Therefore, the gap setting members 20 were not damaged or worn as much. However, the charge roller 11 vibrated while rotating, and the gap G was fluctuated, thereby causing charge irregularity.

As described above, in the first embodiment, the pressing members 31 press the charge roller 11 against the photosensitive drum 12 at the positions corresponding to the gap setting members 20. Accordingly, it is possible to reduce a strain in the charge roller 11. As a result, it is possible to uniformly form the gap G between the charge roller 11 and the photosensitive drum 12, thereby stably charging the photosensitive drum 12. Further, it is not necessary to machine the charge roller 11 in a crown shape, thereby decreasing cost of the image forming apparatus. Also, it is possible to reduce the outer diameter of the charge roller 11, thereby decreasing a size of the image forming apparatus.

Further, the gap setting members 20 and the pressing members 31 are formed of a material with a low coefficient of friction, and the width W1 of the pressing members 31 is smaller than the width W2 of the gap setting members 20. Accordingly, even when the gap setting members 20 are damaged or worn, it is still possible to stably form the gap G, thereby consistently charging the photosensitive drum 12.

A second embodiment of the present invention will be explained next. Components having structures same as those in the first embodiment are designated with the same reference numerals, and explanations thereof are omitted. The components having structures same as those in the first embodiment have the same effects.

Figure 5:
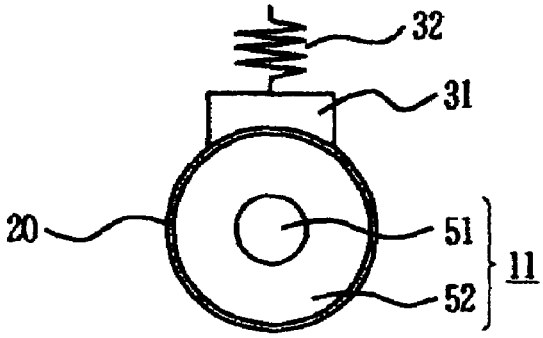
FIG. 5 is a schematic sectional view showing a charge device according to a second embodiment of the present invention.

FIG. 5 is a schematic sectional view showing a charge device according to the second embodiment of the present invention. In the second embodiment, the gap setting members 20 or the pressing members 31 are formed of polytetrafluoroethylene (PTFE) having an extremely low coefficient of friction.

The continuous printing test was conducted under conditions same as those in the first embodiment to compare a first example of the second embodiment, a second example of the second embodiment, and a comparative example. The result is shown in Table 2. In the continuous printing test, the gap stability (gap setting member durability) was evaluated after the photosensitive drum 12 was rotated 40000 times, longer than 30000 times, which is regarded as a life of an ID cartridge.

TABLE 2

| | First example | Second example | Comparative example |
|---|---|---|---|
| Pressing member | POM + PTFE | POM | POM |
| Pressing force (gf) | 250 | 250 | 250 |
| Gap setting member | PET | PTFE | PET |
| Pressing location | Gap setting member | Gap setting member | Gap setting member |
| W1 vs. W2 | W1 < W2 | W1 < W2 | W1 < W2 |
| Initial Gap Uniformity | Good | Good | Good |
| Gap Stability (gap setting member durability) | Good | Good | Fair |

In the first example of the second embodiment, the pressing members 31 are formed of polyacetal containing polytetrafluoroethylene. In the second example of the second embodiment, the gap setting members 20 are formed of polytetrafluoroethylene. The comparative example is the same as that in the first embodiment, and the pressing members 31 are formed of polyacetal, and the gap setting members 20 are formed of polyethylene terephthalate.

As shown in Table 2, in the comparative example, it was possible to stably charge the photosensitive drum 12 after the photosensitive drum 12 was rotated 30000 times, which was regarded as a life of an ID cartridge, and the image quality was good. However, when the photosensitive drum 12 was rotated 40000 times, longer than 30000 times, the gap setting members 20 were slightly worn and the image in half tone slightly showed irregularity. On the other hand, in the first example of the second embodiment, since the pressing members 31 contain polytetrafluoroethylene, it was possible to reduce a coefficient of friction of the pressing members 31. Accordingly, as compared with the comparative example, it was possible to reduce a wear amount of the gap setting members 20, thereby consistently charging the photosensitive drum 12 longer than the life of the ID cartridge. In the first example of the second embodiment, when the pressing members 31 contain polytetrafluoroethylene at a higher level, it is possible to obtain the pressing members 31 with a lower coefficient of friction. In a normal charge device (the charge roller rotates at a rate greater than 30 rpm, and the pressing force is greater than 150 gf), it is preferred that the pressing members 31 contain polytetrafluoroethylene at a level of more than 5%, more preferably more than 10%, of polytetrafluoroethylene to obtain sufficient wear resistance and improved durability.

In the second example of the second embodiment, since the gap setting members 20 were formed of polytetrafluoroethylene, it was possible to reduce a coefficient of friction of the gap setting members 20. Accordingly, as compared with the comparative example, it was possible to reduce a wear amount of the gap setting members 20, thereby consistently charging the photosensitive drum 12 longer than the life of the ID cartridge.

As explained above, in the second embodiment, the gap setting members 20 or the pressing members 31 are formed of polytetrafluoroethylene (PTFE), thereby reducing a coefficient of friction. Accordingly, it is possible to stably form the gap G for a further long time, thereby consistently charging the photosensitive drum 12.

A third embodiment of the present invention will be explained next. Components having structures same as those in the first and second embodiments are designated with the same reference numerals, and explanations thereof are omitted. The components having structures same as those in the first and second embodiments have the same effects.

Figure 6:
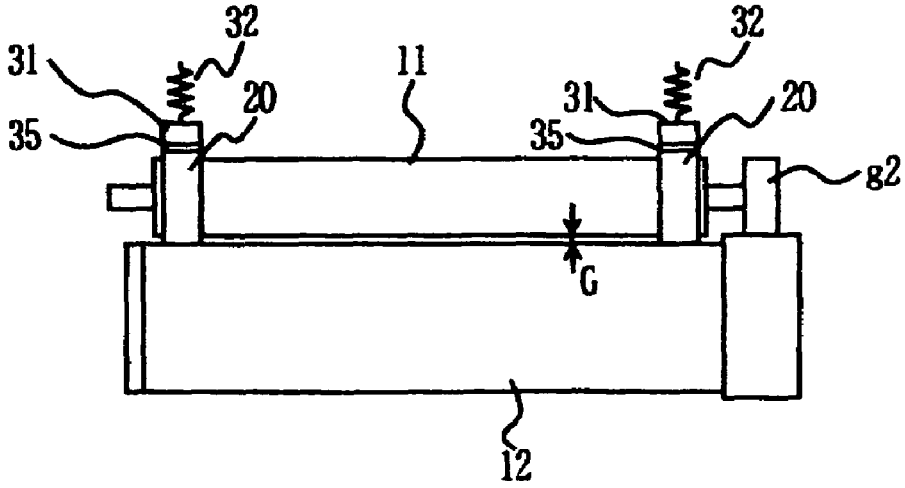
FIG. 6 is a schematic view showing a charge device according to a third embodiment of the present invention.
Figure 7:
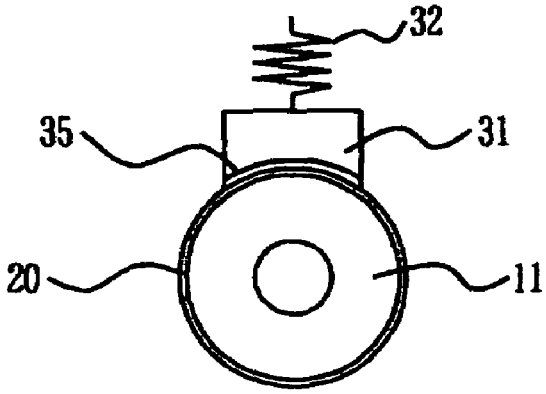
FIG. 7 is a schematic sectional view of the charge device according to the third embodiment of the present invention.

FIG. 6 is a schematic view showing a charge device according to the third embodiment of the present invention. FIG. 7 is a schematic sectional view of the charge device according to the third embodiment of the present invention.

In the third embodiment, protection members 35 formed of a film are provided between the pressing members 31 and the gap setting members 20. The protection members 35 are formed of a film coated with a silicone resin for reducing a coefficient of friction. The film may be formed of a resin such as polyethylene terephthalate, polyester, polyethylene, polypropylene, a urethane resin, a silicone resin, a melamine resin, an acryl resin, an epoxy resin, a phenol resin, a fluoride resin, o-cresolphthalein complexone, polyetheretherketone, and polyphenylene sulfide (PPS).

An adhesive or an adhesive tape is attached to one surface of each of the protection members 35, so that the protection members 35 are attached to surfaces of the pressing members 31 sliding against the gap setting members 20. In the embodiment, the protection members 35 are disposed between the pressing members 31 and the gap setting members 20, so that a wear amount of the protection members 35 becomes greater than that of the gap setting members 20 when the gap setting members 20 and the protection members 35 are worn according to the wear test (JISK 7204).

In the wear test, the pressing members 31 and the protection members 35 are worn under abrasive wear. However, the pressing members 31 and the protection members 35 may be worn under cohesive wear, fatigue wear, and chemical wear as well. A wear amount may vary depending on a condition such as a load, a temperature, and a rate. In the charge device according to the embodiment, when toner as developer or a foreign matter such as paper dust enters between the gap setting members 20 and the photosensitive drum 12, the wear of the gap setting members 20 tends to be promoted substantially. In this case, the gap setting members 20 may be damaged, thereby making the rotation of the charge roller 11 unstable. This type of wear is considered to be similar to the abrasive wear, which was confirmed in the test result shown in Table 3, in which combinations of materials having different wear characteristics were evaluated.

example of the third embodiment, a third example of the third embodiment, a first comparative example, and a second comparative example. In the continuous printing test, the photosensitive drum 12 rotated at 40 rpm. In order to evaluate performance properly, the protection members 35 had a width same as the width W1 of the pressing members 31, and the width W1 of the pressing members 31 were set to be equal to the width W2 of the gap setting members 20. The pressing force of the springs 32 was set at 450 gf, larger than a normal force.

TABLE 3

| | First example | Second example | Third example | First comparative example | Second comparative example |
|---|---|---|---|---|---|
| Pressing member | POM | POM | POM | POM | POM |
| Protection member | PP | Urethane resin | PET | None | PET |
| Pressing force (gf) | 450 | 450 | 450 | 450 | 450 |
| Gap setting member | PET | PET | PET | PES | PES |
| Pressing location | Gap setting member | Gap setting member | Gap setting member | Gap setting member | Gap setting member |
| W1 vs. W2 | W1 = W2 | W1 = W2 | W1 = W2 | W1 = W2 | W1 = W2 |
| Initial Gap Uniformity | Good | Good | Good | Good | Good |
| Gap Stability (gap setting member durability) | Good | Good | Fair | Poor | Poor |
| Wear Property | Protection member < Gap setting member | Protection member < Gap setting member | Protection member = Gap setting member | Protection member > Gap setting member | Protection member > Gap setting member |

In order to reduce the wear amount of the gap setting members 20 under the abrasive wear, it is found that the protection members 35 and the pressing members 31 are preferably formed of a material selected according to an inverse of a product of a tensile strength of the material (MPa) and an elongation (%). That is, in the embodiment, the material is selected according to the following equation (1).

$$1/s1\cdot\epsilon1 \leqq 1/s2\cdot\epsilon2 \ (\mathrm{cm}^2/\mathrm{kgf}) \quad (1)$$

where s1 is a tensile strength of the material of the gap setting members 20; ϵ1 is an elongation of the material of the gap setting members 20; s2 is a tensile strength of the material of the protection members 35; and ϵ2 is an elongation of the material of the protection members 35. The elongation of a material is defined as follows: first, two reference points separated by a distance L0 in a direction of tensile elongation are marked on a specimen; second, after the specimen is broken in a tensile test, a distance L1 between the two reference points is measured; and third, the elongation is defined by 100×(L1−L0)/L0.

Further, the protection members 35 are preferably formed of a material having a coefficient of friction lower than that of the gap setting members 20 for reducing friction between the protection members 35 and the gap setting members 20, so that the charge roller 11 rotates smoothly.

The continuous printing test was conducted under conditions same as those in the first and second embodiments to compare a first example of the third embodiment, a second In Table 3, when the wear amount of the protection members 35 was larger than that of the gap setting members 20, and 1/s1·ϵ1<1/s2·ϵ2 (cm$^2$/kgf), the wear property is designated as "Protection member<Gap setting member". When the wear amount of the protection members 35 was equal to that of the gap setting members 20, and 1/s1·ϵ1=1/s2·ϵ2 (cm$^2$/kgf), the wear property is designated as "Protection member=Gap setting member". When the wear amount of the protection members 35 was smaller than that of the gap setting members 20, and 1/s1·ϵ1>1/s2·ϵ2 (cm$^2$/kgf), the wear property is designated as "Protection member>Gap setting member".

In the first example of the third embodiment, the protection members 35 were formed of polypropylene, and the gap setting members 20 were formed of polyethylene terephthalate, which is more difficult to wear than polypropylene and satisfies the equation (1). In the second example of the third embodiment, the protection members 35 were formed of a urethane resin, and the gap setting members 20 were formed of polyethylene terephthalate. In the third example of the third embodiment, the protection members 35 and the gap setting members 20 were formed of polyethylene terephthalate.

As shown in Table 3, in the first and second comparative examples, the gap setting members 20 were easy to wear as opposed to the protection members 35. Accordingly, the charging became unstable earlier than the first to third examples of the third embodiment. In the third example of the third embodiment, in which the gap setting members 20 and the protection members 35 were formed of the same material, the result was the same as those of the first and second examples of the third embodiment, thereby obtaining an image with good quality. However, as opposed to the first and second examples of the third embodiment, it was visually confirmed that the gap setting members 20 generated a larger wear amount in the third example of the third embodiment. That is, it is preferred that the gap setting members 20 and the protection members 35 are formed of a material with a coefficient of friction as low as possible, in addition to satisfying the equation (1).

As described above, in the third embodiment, the protection members 35 are provided between the pressing members 31 and the gap setting members 20 for reducing the wear of the gap setting members 20. Further, the protection members 35 have a coefficient of friction equal to or smaller than that of the gap setting members 20. Accordingly, it is possible to reduce the wear of the gap setting members 20, thereby making it possible to stably rotate the charge roller 11 for a long period of time and consistently charge the charge roller 11.

As explained above, when toner or a foreign matter such as paper dust enters between the gap setting members 20 and the pressing members 31, or between the gap setting members 20 and the photosensitive drum 12, the wear of the gap setting members 20 tends to be promoted substantially. When an image forming apparatus is operated continuously under such a circumstance, a large amount of foreign matter enters between the gap setting members 20 and the pressing members 31, or between the gap setting members 20 and the photosensitive drum 12. In such a case, the gap setting members 20 may be damaged, thereby making the rotation of the charge roller 11 unstable. Accordingly, it is difficult to stably charge the photosensitive drum 12, thereby deteriorating the image quality.

In a fourth embodiment of the present invention, it is arranged to clean the surfaces of the gap setting members 20. Components having structures same as those in the first to third embodiments are designated with the same reference numerals, and explanations thereof are omitted. The components having structures same as those in the first to third embodiments have the same effects.

Figure 8:
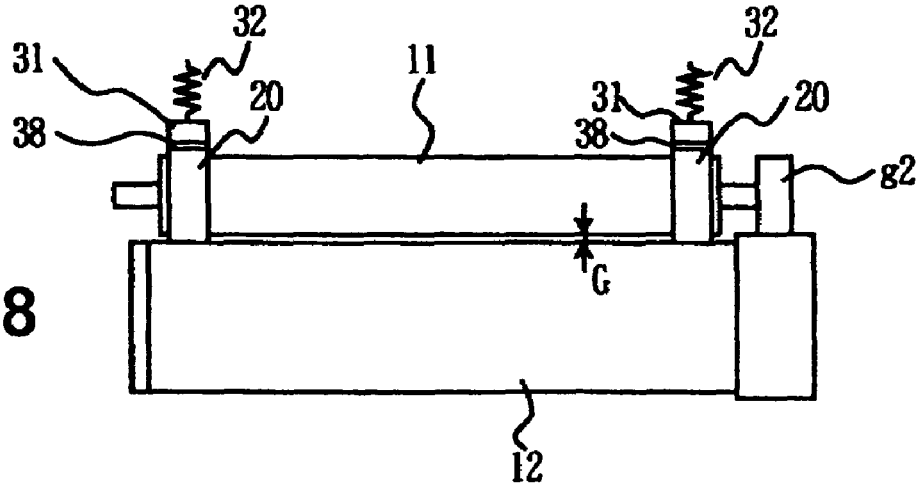
FIG. 8 is a schematic view showing a charge device according to a fourth embodiment of the present invention.
Figure 9:
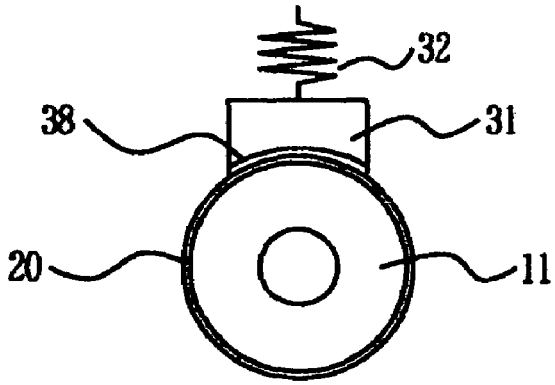
FIG. 9 is a schematic sectional view of the charge device according to the fourth embodiment of the present invention.

FIG. 8 is a schematic view showing a charge device according to the fourth embodiment of the present invention. FIG. 9 is a schematic sectional view of the charge device according to the fourth embodiment of the present invention.

In the fourth embodiment, cleaning members 38 are provided on the pressing members 31 over the whole or a part of surfaces thereof sliding against the gap setting members 20 for removing a foreign matter on the surfaces of the gap setting members 20. The cleaning members 38 are formed of a felt, and may be formed of a sheet member of a synthetic fiber such as polyethylene, polyester, polyethylene terephthalate, nylon, polypropylene, and a mixture thereof. Further, a foam sponge formed of a material such as a urethane rubber, a silicone rubber, and an EPDM rubber may be used. In this case, a surface of a foam sponge may be coated or modified for reducing a coefficient of friction. When the cleaning members 38 have a large coefficient of friction, the cleaning members 38 may damage the gap setting members 20. Accordingly, it is preferred that the cleaning members 38 are formed of a material with a low coefficient of friction and difficult to damage for efficiently removing a foreign matter. When the cleaning members 38 are formed of a felt or a synthetic fiber sheet, it is possible to obtain a good result.

The continuous printing test was conducted under conditions same as those in the first to third embodiments to compare a first example of the fourth embodiment, a second example of the fourth embodiment, a third example of the fourth embodiment, and a comparative example. In the test, in order to evaluate performance properly, the cleaning members 38 had a width same as the width W1 of the pressing members 31, and the width W1 of the pressing members 31 were set to be equal to the width W2 of the gap setting members 20.

TABLE 4

| | First example | Second example | Third example | Comparative example |
|---|---|---|---|---|
| Pressing member | POM | POM | POM | POM |
| Cleaning member | Felt | Urethane foam sponge | PES | None |
| Pressing force (gf) | 450 | 450 | 450 | 450 |
| Gap setting member | PET | PET | PET | PES |
| Pressing location | Gap setting member | Gap setting member | Gap setting member | Gap setting member |
| W1 vs. W2 | W1 = W2 | W1 = W2 | W1 = W2 | W1 = W2 |
| Initial Gap Uniformity | Good | Good | Good | Good |
| Gap Stability (gap setting member durability) | Good | Fair | Good | Poor |

As shown in Table 4, in the first example of the fourth embodiment, the cleaning members 38 were formed of felt. In the second example of the fourth embodiment, the cleaning members 38 were formed of a foam sponge of a urethane rubber, or a urethane foam sponge, having a cell number of 80 to 100 pieces/inch, a hardness of 50° (Asker F), and an insulative property. In the third example of the fourth embodiment, the cleaning members 38 were formed of a polyester sheet member. In the comparative example, the cleaning members 38 were not provided, and the gap setting members 20 were formed of polyester.

As shown in Table 4, when the cleaning members 38 were provided, as opposed to the comparative example, the wear amount of the gap setting members 20 was reduced, thereby obtaining high durability. In the first and third examples of the fourth embodiment, it was possible to eliminate a foreign matter, so that the wear amount of the gap setting members 20 was reduced and the cleaning members 38 themselves were not severely damaged. In the second example of the fourth embodiment, it was possible to eliminate a foreign matter, so that the wear amount of the gap setting members 20 was reduced and the cleaning members 38 themselves were not relatively damaged.

As described above, in the fourth embodiment of the present invention, the cleaning members 38 are disposed on the surfaces of the pressing members 31. Accordingly, it is possible to remove a foreign matter on the gap setting members 20, thereby preventing the gap setting members 20 from wearing, being damaged, or being deteriorated. As a result, it is possible to stably rotate the charge roller 11 for a long period of time, thereby consistently charging the photosensitive drum 12.

In the fourth embodiment, when the cleaning members 38 are clogged with a foreign matter, the cleaning members 38 may damage the gap setting members 20 through the pressure applied thereto. Especially when the charge roller 11 rotates at a high speed, or has a small diameter, the gap setting members 20 tend to be damaged more easily. In a fifth embodiment of the present invention, it is arranged to prevent the gap setting members 20 from being damaged. Components having structures same as those in the first to fourth embodiments are designated with the same reference numerals, and explanations thereof are omitted. The components having structures same as those in the first to fourth embodiments have the same effects.

Figure 10:
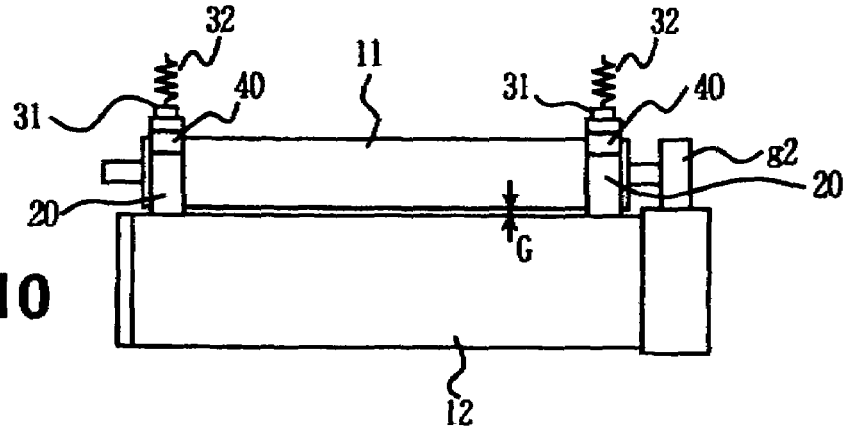
FIG. 10 is a schematic view showing a charge device according to a fifth embodiment of the present invention.
Figure 11:
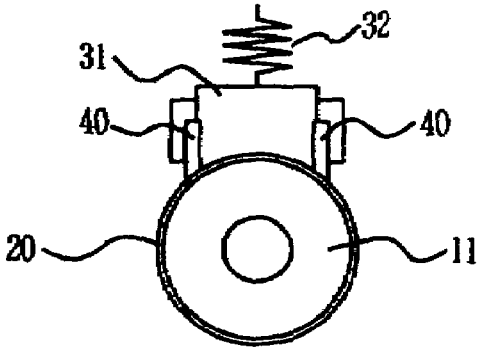
FIG. 11 is a schematic sectional view of the charge device according to the fifth embodiment of the present invention.

FIG. 10 is a schematic view showing a charge device according to the fifth embodiment of the present invention. FIG. 11 is a schematic sectional view of the charge device according to the fifth embodiment of the present invention.

In the fifth embodiment, the pressing members 31 are disposed on the gap setting members 20. Cleaning members 40 are disposed at least one, both in the embodiment, of an upstream side and a downstream side of the pressing members 31 in a rotational direction of the charge roller 11 along side surfaces of the pressing members 31. End portions of the cleaning members 40 abut against the gap setting members 20.

The cleaning members 40 are formed of a foam sponge formed of a material having an insulative property such as a urethane rubber, a silicone rubber, and an EPDM rubber. The foam sponge may include a felt attached a surface thereof sliding against the gap setting members 20. A fiber brush having an insulative property may also be used. Instead of the felt, it is possible to use a sheet member of a synthetic fiber such as polyethylene, polyester, polyethylene terephthalate, nylon, polypropylene, and a mixture thereof; or a sheet member of a fiber such as rayon, cotton, and a mixture thereof. When the foam sponge is not covered with the felt, it is preferred that such a surface may be modified for reducing a coefficient of friction.

In the embodiment, the cleaning members 40 are attached to the side surfaces of the pressing members 31 with an adhesive member such as an adhesive and a double side tape. As shown in FIG. 11, the pressing members 31 have a specific shape for positioning the cleaning members 40 and improving durability. As described above, the cleaning members 40 are disposed at both sides of the pressing members 31 in the rotational direction of the charge roller 11. Accordingly, when the springs 32 apply the pressing force to the gap setting members 20 through the pressing members 31, the cleaning members 40 apply only a small pressing force to the gap setting members 20, thereby preventing the gap setting members 20 from being damaged.

The continuous printing test was conducted under conditions same as those in the third embodiment to compare a first example of the fifth embodiment, a second example of the fifth embodiment, a third example of the fifth embodiment, a fourth example of the fifth embodiment, a fifth example of the fifth embodiment, a first comparative example, and a second comparative example. The result is shown in Table 5.

TABLE 5

| | First example | Second example | Third example | Fourth example | Fifth example | First comparative example | Second comparative example |
|---|---|---|---|---|---|---|---|
| Pressing member | POM | POM | POM | POM | POM | POM | POM |
| Cleaning member | Urethane foam sponge | Urethane foam sponge | Nylon (brush) | Urethane foam sponge | Urethane foam sponge | Felt | None |
| Surface of cleaning member | Felt | PES | None | None | Felt | None | None |
| Pressing force (gf) | 450 | 450 | 450 | 450 | 450 | 450 | 450 |
| Gap setting member | PET | PET | PET | PET | PET | PET | PET |
| Cleaning member location | Up. side* Down. side** | Up. side* Down. side** | Up. side* Down. side** | Up. side* Down. side** | Up. side* | Between pressing member and Gap setting member | None |
| W1 vs. W2 | W1 = W2 | W1 = W2 | W1 = W2 | W1 = W2 | W1 = W2 | W1 = W2 | W1 = W2 |
| Initial Gap Uniformity | Good | Good | Good | Good | Good | Good | Good |
| Gap Stability (gap setting member durability) | Good | Good | Good | Good | Good | Good | Poor |
| Damage on gap setting member (after 600000 rotations) | Good | Good | Fair | Good | Good | Poor | Poor |

*up. side; upstream side
**down. side; downstream side

As shown in Table 5, in the first example of the fifth embodiment, the cleaning members 40 were formed of the urethane foam sponge having a cell number of 80 to 100 pieces/inch, a hardness of 50° (JISA), and an insulating property. The felt was attached to the surfaces of the cleaning members 40 sliding against the gap setting members 20. In the second example of the fifth embodiment, the cleaning members 40 were formed of the urethane foam sponge, and the polyester sheet was attached to the surfaces of the cleaning members 40 sliding against the gap setting members 20. In the third example of the fifth embodiment, the cleaning members 40 were formed of the nylon brush. In the fourth example of the fifth embodiment, the cleaning members 40 were formed of the urethane foam sponge. In the fifth example of the fifth embodiment, the cleaning members 40 were formed of the urethane foam sponge, and the felt was attached to the surfaces of the cleaning members 40 sliding against the gap setting members 20. Further, the cleaning members 40 were disposed on one side, the upstream side in the test, in the rotational direction of the charge roller 11. The fiber brush was formed of nylon in a brush shape.

In the first comparative example, similar to the first example of the fourth embodiment, the cleaning members 38 formed of the felt were disposed between the pressing members 31 and the gap setting members 20. In the second comparative example, the cleaning members 40 were not provided.

As shown in Table 5, it was possible to reduce the pressing force of the cleaning members 40 sliding against the gap setting members 20 in the first to fifth examples of the fifth embodiment. Accordingly, it was possible to reduce the friction, thereby stably rotating the charge roller 11 for a long period of time and consistently charging the photosensitive drum 12. In the third example of the fifth embodiment, when the photosensitive drum 12 rotated for 60000 rotations, it was found that the gap setting members 20 were slightly damaged at end portions thereof. In this case, it was confirmed that the gap G was properly formed.

In the fifth example of the fifth embodiment, the cleaning members 40 were disposed on the upstream side in the rotational direction of the charge roller 11, and it was confirmed that sufficient effect was obtained. In the second comparative example, the cleaning members 40 were not provided. Accordingly, a foreign matter stuck to the gap setting members 20, and it was difficult to stably form the gap G. Further, the gap setting members 20 might be damaged due to the friction between the pressing members 31 and the gap setting members 20. Accordingly, it was difficult to stably rotate the charge roller 11, thereby causing unstable charging.

As described above, in the fifth embodiment, the cleaning members 40 are disposed on at least one of the upstream side and the downstream side of the pressing members 31 in the rotational direction of the charge roller 11. Accordingly, it is possible to press the cleaning members 40 against the gap setting members 20 with a proper pressing force. As a result, it is possible to reduce damage on the gap setting members 20, and to stably charge the photosensitive drum 12 for a long period of time even when the charge roller 11 rotates at a high speed.

A sixth embodiment of the present invention will be explained next. Components having structures same as those in the first to fifth embodiments are designated with the same reference numerals, and explanations thereof are omitted. The components having structures same as those in the first to fifth embodiments have the same effects.

Figure 12:
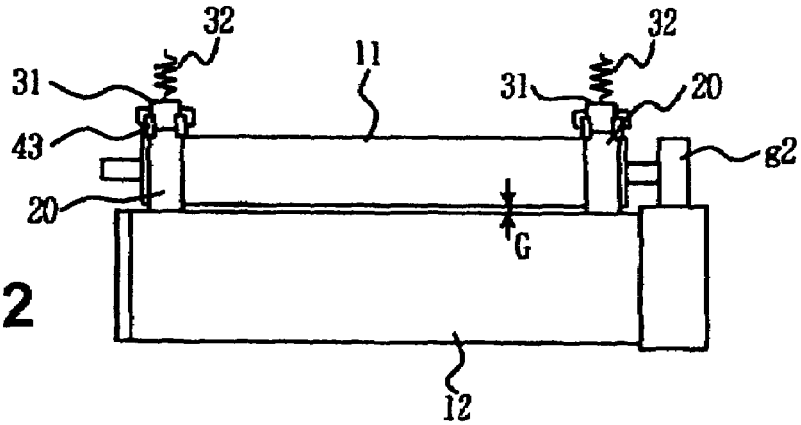
FIG. 12 is a schematic view showing a charge device according to a sixth embodiment of the present invention.
Figure 13:
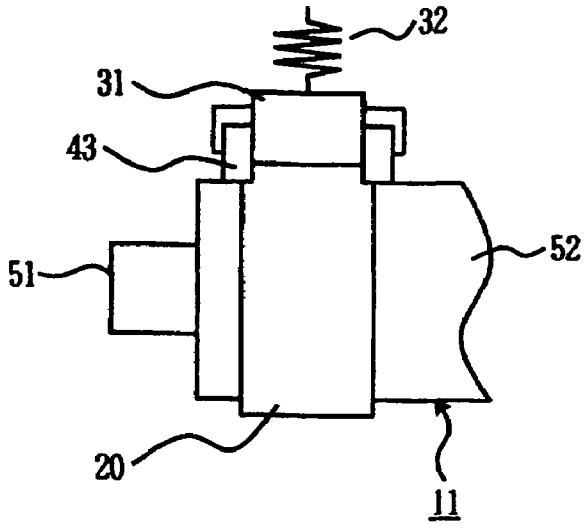
FIG. 13 is a schematic detailed view of the charge device according to the sixth embodiment of the present invention.

FIG. 12 is a schematic view showing a charge device according to the sixth embodiment of the present invention. FIG. 13 is a schematic detailed view of the charge device according to the sixth embodiment of the present invention.

In the sixth embodiment, seal members 43 are disposed at boundaries between the gap setting members 20 and the elastic layer 52 with end portions thereof abutting against the boundaries. The seal members 43 are formed of a foam sponge formed of a material having an insulative property such as a urethane rubber, a silicone rubber, and an EPDM rubber. The foam sponge may include a felt attached a surface thereof sliding against the gap setting members 20. A fiber brush having an insulative property may also be used. Instead of the felt, it is possible to use a sheet member of a synthetic fiber such as polyethylene, polyester, polyethylene terephthalate, nylon, polypropylene, and a mixture thereof; or a sheet member of a fiber such as rayon, cotton, and a mixture thereof. When the foam sponge is not covered with the felt, it is preferred that such a surface may be modified for reducing a coefficient of friction.

In the sixth embodiment, the seal members 43 are attached to side surfaces of the pressing members 31 with an adhesive member such as an adhesive and a double side tape. In this case, the seal members 43 prevent a foreign matter from entering between the pressing members 31 and the gap setting members 20, rather than removing a foreign matter. Accordingly, not only it is possible to prevent the gap setting members 20 from being damaged due to the friction between the seal members 43 and the gap setting members 20, but also the seal members 43 may be formed of a material with less limitations and the pressing force may be set with less limitations.

The continuous printing test was conducted under conditions same as those in the third embodiment to compare a first example of the sixth embodiment, a second example of the sixth embodiment, a third example of the sixth embodiment, a first comparative example, and a second comparative example. The result is shown in Table 6.

TABLE 6

| | First example | Second example | Third example | First comparative example | Second comparative example |
|---|---|---|---|---|---|
| Pressing member | POM | POM | POM | POM | POM |
| Seal member | Urethane foam sponge | Urethane foam sponge | Urethane foam sponge | None | None |
| Surface of seal member | Felt | PES | None | None | None |
| Pressing force (gf) | 450 | 450 | 450 | 450 | 450 |
| Gap setting member | PET | PET | PET | PET | PET |

TABLE 6-continued

| | First example | Second example | Third example | First comparative example | Second comparative example |
|---|---|---|---|---|---|
| Cleaning member | None | None | None | Felt | Felt |
| Position of cleaning member | None | None | None | Upstream side downstream side | Between pressing member and gap setting member |
| Initial Gap Uniformity | Good | Good | Good | Good | Good |
| Gap Stability (gap setting member durability) | Good | Good | Good | Good | Good |
| Damage on gap setting member (after 12000 rotations) | Good | Good | Fair | Poor | Poor |

As shown in Table 6, in the first example of the sixth embodiment, the seal members 43 were formed of the urethane foam sponge, and the felt was attached to the surfaces of the seal members 43 sliding against the gap setting members 20. In the second example of the sixth embodiment, the seal members 43 were formed of the urethane foam sponge, and the polyester sheet was attached to the surfaces of the seal members 43 sliding against the gap setting members 20. In the third example of the sixth embodiment, the seal members 43 were formed of the urethane foam sponge.

As shown in Table 6, in the first and second examples of the sixth embodiment, the seal members 43 prevented a foreign matter from entering. Accordingly, it was possible to prevent damage on the gap setting members 20 even after the photosensitive drum 12 rotated for 120000 rotations. In the third example of the sixth embodiment, it was found that the gap setting members 20 were slightly damaged at end portions thereof. In this case, it was confirmed that the gap G was properly formed.

In the first and second comparative examples, it was possible to stably form the gap G up to 60000 rotations. However, after the photosensitive drum 12 rotated for 120000 rotations, it was found that the gap setting members 20 were peeled off, damaged, or cracked. Accordingly, it was difficult to stably charge the photosensitive drum 12, thereby deteriorating the image quality.

As described above, in the sixth embodiment, the seal members 43 are disposed for preventing a foreign matter from entering between the pressing members 31 and the gap setting members 20. Accordingly, it is possible to reduce damage on the gap setting members 20, and to stably charge the photosensitive drum 12 for a long period of time even when the charge roller 11 rotates at a high speed.

A seventh embodiment of the present invention will be explained next. Components having structures same as those in the first to sixth embodiments are designated with the same reference numerals, and explanations thereof are omitted. The components having structures same as those in the first to sixth embodiments have the same effects.

Figure 14:
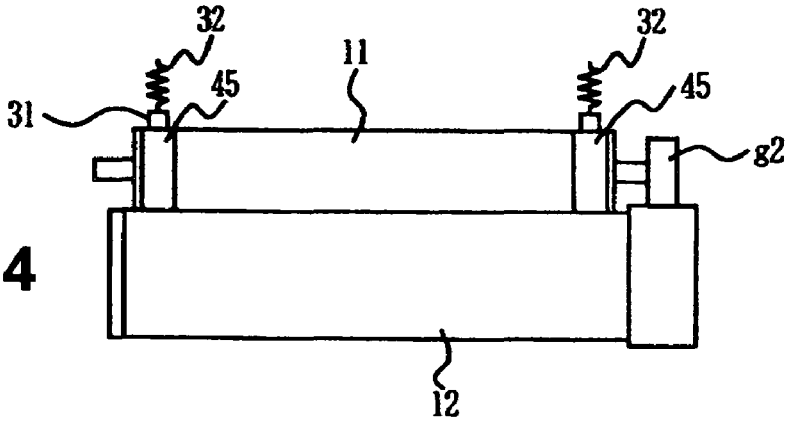
FIG. 14 is a schematic view showing a charge device according to a seventh embodiment of the present invention.
Figure 15:
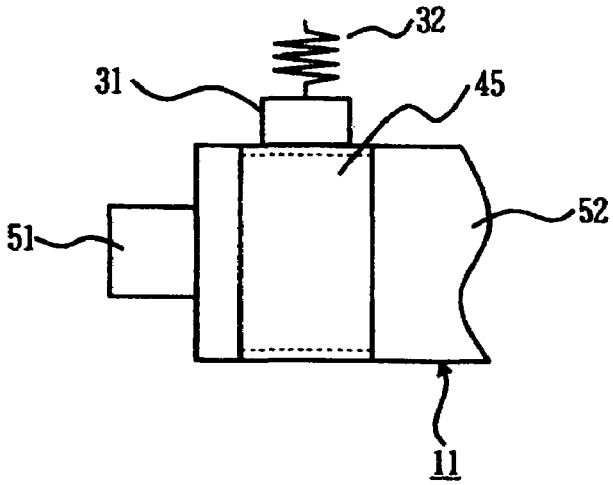
FIG. 15 is a schematic detailed view of the charge device according to the seventh embodiment of the present invention.

FIG. 14 is a schematic view showing a charge device according to the seventh embodiment of the present invention. FIG. 15 is a schematic detailed view of the charge device according to the seventh embodiment of the present invention.

In the seventh embodiment, the charge device is a contact-type. In the charge roller 11 formed of the shaft 51 with conductivity and the elastic layer 52 coated thereon, gap setting members 45 are disposed on the surface of the elastic layer 52 at both ends thereof as a circular member for covering the elastic layer 52. The pressing members 31 are disposed on the gap setting members 45 for pressing the charge roller 11 against the photosensitive drum 12, so that the charge roller 11 contacts with the photosensitive drum 12 over the charge area.

In the embodiment, the elastic layer 52 has step portions in the surface thereof having a depth (step) about same as a thickness of the gap setting members 45. The step portions have a width same as that of the gap setting members 45. Accordingly, when the gap setting members 45 are disposed on the elastic layer 52, an outer diameter of the gap setting members 45 is about the same as that of the elastic layer 52. As a result, the gap setting members 45 set the gap G to zero over the charge area on the photosensitive drum 12. The step portions may be formed through machining the surface of the elastic layer 52, or may be molded in during a molding process using a mold.

In the embodiment, the gap setting members 45 have a hardness greater than that of the elastic layer 52. Accordingly, when the springs 32 press the charge roller 11 against the photosensitive drum 12, the charge roller 11 is pressed against the photosensitive drum 12 with a pressing force smaller than that in a case without the gap setting members 45. Further, it is possible to improve durability of the gap setting members 45 similar to the gap setting members 20 in the previous embodiments when the pressing members 31 are disposed on the gap setting members 45. The gap setting members 45 may be formed of a material similar to the gap setting members 20 in the previous embodiments.

In the contact-type charge device, when an operation is repeated continuously, toner or a foreign matter may stick to the surface of the charge roller 11, or surfaces of the gap setting members 45. When toner sticking to the surface is crashed with friction or heat, toner-filming phenomenon may occur, thereby causing a problem in charging over the charge area. In the seventh embodiment, the charge roller 11 is pressed with a small pressing force due to the gap setting members 45. Accordingly, it is possible to prevent the toner-filming phenomenon, thereby preventing the problem in charging over the charge area.

In the embodiment, the gap setting members 45 and the pressing members 31 may have a width adjusted as explained above to prevent a foreign matter from sticking to the gap setting members 45. Further, the gap setting members 45 may be formed of a material containing polytetrafluoroethylene, and the cleaning members 40 or the seal members 43 may be provided.

The continuous printing test was conducted using the configuration of the seventh embodiment. It was found that it was possible to stably charge the photosensitive drum 12 without causing the toner-filming phenomenon. Further, there was not a gap between the charge roller 11 and the photosensitive drum 12, thereby obtaining good uniformity and durability.

The disclosure of Japanese Patent Application No. 2005-044330, filed on Feb. 21, 2005, is incorporated in the application.

While the invention has been explained with reference to the specific embodiments of the invention, the explanation is illustrative and the invention is limited only by the appended claims.

What is claimed is:

1. An image forming apparatus, comprising:

an image supporting member;

a charge member for charging the image supporting member;

a gap setting member disposed on the charge member for setting a gap between the image supporting member and the charge member; and a pressing member disposed at a position directly corresponding to the gap setting member for pressing the charge member against the image supporting member with the gap setting member inbetween the pressing member and the image supporting member.

2. The image forming apparatus according to claim 1, wherein said gap setting member is arranged in a cyclic shape to cover the charge member at both end portions of the charge member.

3. The image forming apparatus according to claim 1, wherein said pressing member has a width smaller than that of the gap setting member.

4. The image forming apparatus according to claim 1, wherein at least one of said pressing member and said gap setting member is formed of a material containing polytetrafluoroethylene.

5. The image forming apparatus according to claim 1, further comprising a protection member disposed on a surface of the pressing member sliding against the gap setting member.

6. The image forming apparatus according to claim 5, wherein said gap setting member is formed of a first material and said protection member is formed of a second material such that a following relationship is established, $$1/s1\cdot\epsilon1 \leqq 1/s2\cdot\epsilon2\ (\mathrm{cm}^2/\mathrm{kgf}),$$

where s1 is a tensile strength of the first material; ϵ1 is an elongation of the first material; s2 is a tensile strength of the second material; and ϵ2 is an elongation of the second material.

7. The image forming apparatus according to claim 1, further comprising a cleaning member disposed on a surface of the pressing member sliding against the gap setting member for cleaning the gap setting member.

8. The image forming apparatus according to claim 7, wherein said cleaning member is formed of a felt or a sheet of synthetic fiber.

9. The image forming apparatus according to claim 1, further comprising a cleaning member disposed on a side of the pressing member in a rotational direction of the charge member for cleaning the gap setting member.

10. The image forming apparatus according to claim 9, wherein said cleaning member is formed of a foam sponge.

11. The image forming apparatus according to claim 10, wherein said cleaning member includes a felt member or a sheet member formed of synthetic fiber attached on a surface thereof sliding against the gap setting member.

12. The image forming apparatus according to claim 9, wherein said cleaning member is formed of a fiber brush.

13. The image forming apparatus according to claim 1, further comprising a seal member for sealing a boundary between the gap setting member and a rotational surface of the charge member.

14. The image forming apparatus according to claim 13, wherein said seal member is formed of a foam sponge.

15. The image forming apparatus according to claim 14, wherein said seal member includes a felt member or a sheet member formed of synthetic fiber attached on a surface thereof sliding against the gap setting member.

16. The image forming apparatus according to claim 13, wherein said cleaning member is formed of a fiber brush.

17. The image forming apparatus according to claim 1, wherein said gap setting member has an outer diameter substantially same as that of the charge member.

18. The image forming apparatus according to claim 1, wherein said pressing member is disposed at a position facing the gap setting member.

19. The image forming apparatus according to claim 5, wherein said protection member is formed of a material having a wear amount larger than that of the gap setting member under an abrasive condition.

20. The image forming apparatus according to claim 5, wherein said protection member is formed of a resin material and said gap setting member is formed of polyethylene terephthalate.

21. The image forming apparatus according to claim 5, wherein said protection member is formed of at least one of polyethylene terephthalate, polyester, polyethylene, polypropylene, a urethane resin, a silicone resin, a melamine resin, an acryl resin, an epoxy resin, a phenol resin, a fluoride resin, o-cresolphthalein complexone, polyetheretherketone, and polyphenylene sulfide.

22. The image forming apparatus according to claim 5, wherein said protection member is formed of a film member.

23. The image forming apparatus according to claim 1, wherein said image supporting member is arranged to be away from the charge member by a distance in a range of 20 to 100 μm.

24. The image forming apparatus according to claim 1, wherein said pressing member is arranged to press the charge member with a force in a range of 150 to 500 gf.

25. The image forming apparatus according to claim 1, wherein said charge member is arranged to simultaneously receive a direct current voltage and an alternate current voltage.

26. The image forming apparatus according to claim 1, further comprising a rotation transmission member for transmitting rotations between the image supporting member and the charge member.

27. The image forming apparatus according to claim 1, further comprising a first gear disposed on the image supporting member and a second gear disposed on the charge member for engaging the first gear, said charge member receiving a rotation of the image supporting member through the first gear and the second gear.

* * * * *